US008599079B2

(12) United States Patent
Kudo et al.

(10) Patent No.: US 8,599,079 B2
(45) Date of Patent: Dec. 3, 2013

(54) WIDEBAND ANTENNA

(75) Inventors: Toshio Kudo, Amagasaki (JP); Shoji Nasu, Amagasaki (JP); Kazuyuki Kashihara, Amagasaki (JP); Toshiyuki Baba, Amagasaki (JP)

(73) Assignee: Mitsubishi Cable Industries, Ltd., Chiyoda-Ku, Tokyo (JP)

( * ) Notice: Subject to any disclaimer, the term of this patent is extended or adjusted under 35 U.S.C. 154(b) by 260 days.

(21) Appl. No.: 13/124,267

(22) PCT Filed: Oct. 14, 2009

(86) PCT No.: PCT/JP2009/005360
§ 371 (c)(1),
(2), (4) Date: Apr. 14, 2011

(87) PCT Pub. No.: WO2010/044262
PCT Pub. Date: Apr. 22, 2010

(65) Prior Publication Data

US 2011/0205132 A1 Aug. 25, 2011

(30) Foreign Application Priority Data

Oct. 17, 2008 (JP) ..... 2008-268242

(51) Int. Cl.
*H01Q 1/32* (2006.01)

(52) U.S. Cl.
USPC ..... 343/713; 343/773

(58) Field of Classification Search
USPC ..... 343/700 MS, 795, 773, 772, 893, 713
See application file for complete search history.

(56) References Cited

U.S. PATENT DOCUMENTS

| | | | | |
|---|---|---|---|---|
| 6,774,859 | B2 | 8/2004 | Schantz et al. | 343/742 |
| 7,265,717 | B2 * | 9/2007 | Saitou et al. | 343/700 MS |
| 7,286,094 | B2 * | 10/2007 | Ratni et al. | 343/773 |
| 7,365,693 | B2 | 4/2008 | Hoshiai et al. | 343/711 |
| 7,414,682 | B2 | 8/2008 | Shiota et al. | 349/114 |
| 7,471,246 | B2 | 12/2008 | Soler Castany et al. MS | 343/700 |
| 7,583,347 | B2 | 9/2009 | Shiota et al. | 349/141 |
| 7,868,841 | B2 | 1/2011 | Pettus | 343/793 |
| 2001/0050651 | A1 | 12/2001 | Grangeat et al. | 343/767 |
| 2005/0088344 | A1 | 4/2005 | Saitou et al. | |
| 2005/0156803 | A1 | 7/2005 | Soler Castany et al. | |
| 2007/0091002 | A1 * | 4/2007 | Noh | 343/713 |

(Continued)

FOREIGN PATENT DOCUMENTS

| | | |
|---|---|---|
| JP | 55-004109 | 1/1980 |
| JP | 03-222504 | 10/1991 |

(Continued)

OTHER PUBLICATIONS

International Search Report dated Nov. 24, 2009 from PCT/JP2009/005360.

(Continued)

*Primary Examiner* — Thien M Le
(74) *Attorney, Agent, or Firm* — Ohlandt, Greeley, Ruggiero & Perle, L.L.P.

(57) ABSTRACT

Disclosed is an antenna capable of receiving a very wide band of frequencies. The antenna includes a pair of antenna elements and a pair of feeding legs, which are arranged symmetrically with respect to a line L, with a narrow space G in between.

9 Claims, 7 Drawing Sheets

(56) References Cited

U.S. PATENT DOCUMENTS

| | | | | |
|---|---|---|---|---|
| 2007/0097009 | A1 | 5/2007 | Torres | |
| 2009/0135068 | A1 * | 5/2009 | Cohen | 343/700 MS |
| 2010/0295750 | A1 * | 11/2010 | See et al. | 343/893 |

FOREIGN PATENT DOCUMENTS

| | | | |
|---|---|---|---|
| JP | 06-268433 | | 9/1994 |
| JP | 08-008628 | | 1/1996 |
| JP | 2000-0068731 | A | 3/2000 |
| JP | 2003-021824 | A | 1/2003 |
| JP | 2005-130292 | A | 5/2005 |
| JP | 2005-277501 | A | 10/2005 |
| JP | 2005-539417 | T | 12/2005 |
| JP | 2007-243908 | A | 9/2007 |
| JP | 2008-166856 | A | 7/2008 |

OTHER PUBLICATIONS

European Office Action dated Aug. 9, 2013 from corresponding EP Application No. 09820440.7, 8 pages.

* cited by examiner (A)

(B)

WIDEBAND ANTENNA

TECHNICAL FIELD

The present disclosure relates to wideband antennas.

BACKGROUND ART

Regarding vehicle antennas, for example, a plurality of antennas for different frequency communications such as AM/FM radio, Vehicle Information and Communication System (VICS), GPS, television (VHF/UHF band), Electronic Toll Collection (ETC) system were necessary to be provided inside or outside a vehicle.

These antennas are preferably positioned as compactly as possible. However, if the antennas are too close to each other, the antennas interfere with each other due to electromagnetic coupling. These antennas may not properly work because of the effect of this interference. To avoid such an interference between antennas, the antennas had to be spaced apart from each other, or laid out appropriately.

The antenna and its relating device are connected together by a cable. Thus, if a plurality of wireless devices using different antennas coexist, the arrangement of cables may be complicated.

On the other hand, various frequency bands are used for wireless communications, such as mobile phones and wireless LANs, as well. In particular, Ultra Wide Band (UWB) communications which have been recently introduced use a very wide band of frequencies ranging from 3.1 to 10.6 GHz. Thus, wideband antennas which can cover the wide frequency band are demanded.

The UWB antenna shown in Patent Document 1 includes two planar antenna elements having a pointed shape, such as a rhombus, a square, and a rectangle. The two planar antenna elements are arranged symmetrically by bringing corners of the two planar antenna elements closer together. A cable is connected such that the corners function as feeding points. The other end of the cable is connected to an electronic circuit, such as a receiver.

CITATION LIST

Patent Document

Patent Document 1: Japanese Patent Publication No. 2005-277501

SUMMARY OF THE INVENTION

Technical Problem

However, a test showed that according to the UWB antenna shown in Patent Document 1, the frequency band achieving a return loss of −10 dB or less (corresponding to a voltage standing wave ratio of 2.0 or less) which is generally required as an antenna, is not so wide as to cover 470 MHz for the digital terrestrial television broadcasting.

FIG. 6(A) is a front view of an antenna 40A having an antenna element 30 of 25 mm squared (referred to as "25 mm squared element"). FIG. 6(B) is a front view of an antenna 40B having an antenna element 30 of 50 mm squared (referred to as "50 mm squared element").

As shown in FIG. 6(A) and FIG. 6(B), the two square, thin metal plates comprising the antenna elements 30, 30 are arranged symmetrically with respect to a line 31. Corners 32, 32 of the antenna elements 30, 30 are placed closer together.

Band-like legs 33, 33 extend parallel to each other from the respective corners 32, 32 along the line 31, with a narrow space K interposed between the band-like legs 33, 33. A lead wire 35 is connected to an outer end 33*a* of each of the legs 33. In other words, the outer end 33*a* functions as a feeding point Q. The antenna 40A is connected to its relating electronic circuit (e.g., a receiver) by a cable 36.

FIG. 7 is a graph showing results of actual measurements of the return losses of the antennas 40A, 40B shown in FIG. 6(A) and FIG. 6(B), respectively. The horizontal axis represents a frequency (GHz). The vertical axis represents a return loss (dB). As shown in FIG. 7, it turned out that the frequency bands WA, WB in which a return loss was −10 dB or less were narrow, and that the antennas 40A, 40B might not be used in practice.

An objective of the present invention is to provide a wideband antenna which is simple in structure and shape, and of which a return loss is sufficiently practical as an antenna in a frequency band sufficiently wider than the conventional frequency band.

Another objective of the present invention is to integrate a lot of antennas necessary for each of a plurality of wireless communication systems in the conventional antennas. Further, another objective of the present invention is to simplify complicated arrangement of the cables by integrating the antennas.

Solution to the Problem

A wideband antenna of the present invention includes a pair of planar, conductive antenna elements; and a pair of planar, conductive band-like feeding legs, wherein the antenna elements are arranged symmetrically with respect to a symmetric axis, the band-like feeding legs are arranged symmetrically with respect to the symmetric axis, with a narrow space interposed between the band-like feeding legs, the band-like feeding legs are connected to adjacent portions of the antenna elements at which the antenna elements are closest to each other, and a width of each of the band-like feeding legs is increased in a direction away from the connecting portion.

According to an embodiment, an outer edge portion of each of the antenna elements that is farthest from the connecting part forms part of an arc, each of the adjacent portions includes part of a phantom arc, and each of the legs is joined to the corresponding antenna element along a direction of a tangent line coming into contact with the phantom arc of the adjacent portion, thereby forming a joint portion.

According to an embodiment, each of the antenna elements forms a closed annular ring having a window in a central region.

According to an embodiment, each of the antenna elements has a substantially oval shape, and an angle at which a longer axis of the oval shape intersects with the symmetric axis is 40° to 100°.

According to an embodiment, the angle at which the longer axis of the oval shape intersects with the symmetric axis is about 90°.

According to an embodiment, transmittances of visible light of the antenna elements and the legs are 70% to 95% so that the antenna elements and the legs are transparent to human eyes.

According to an embodiment, the antenna elements and the legs are provided on a glass surface of a vehicle.

Advantages of the Invention

An antenna having superior return loss characteristics in a very wide frequency band is provided, thereby making it possible to cover from UWB communications to digital terrestrial television broadcasting in a lower frequency band by one type of antenna.

DESCRIPTION OF EMBODIMENTS

Embodiments of the present invention will be described in detail hereinafter with reference to the drawings.

Figure 1:
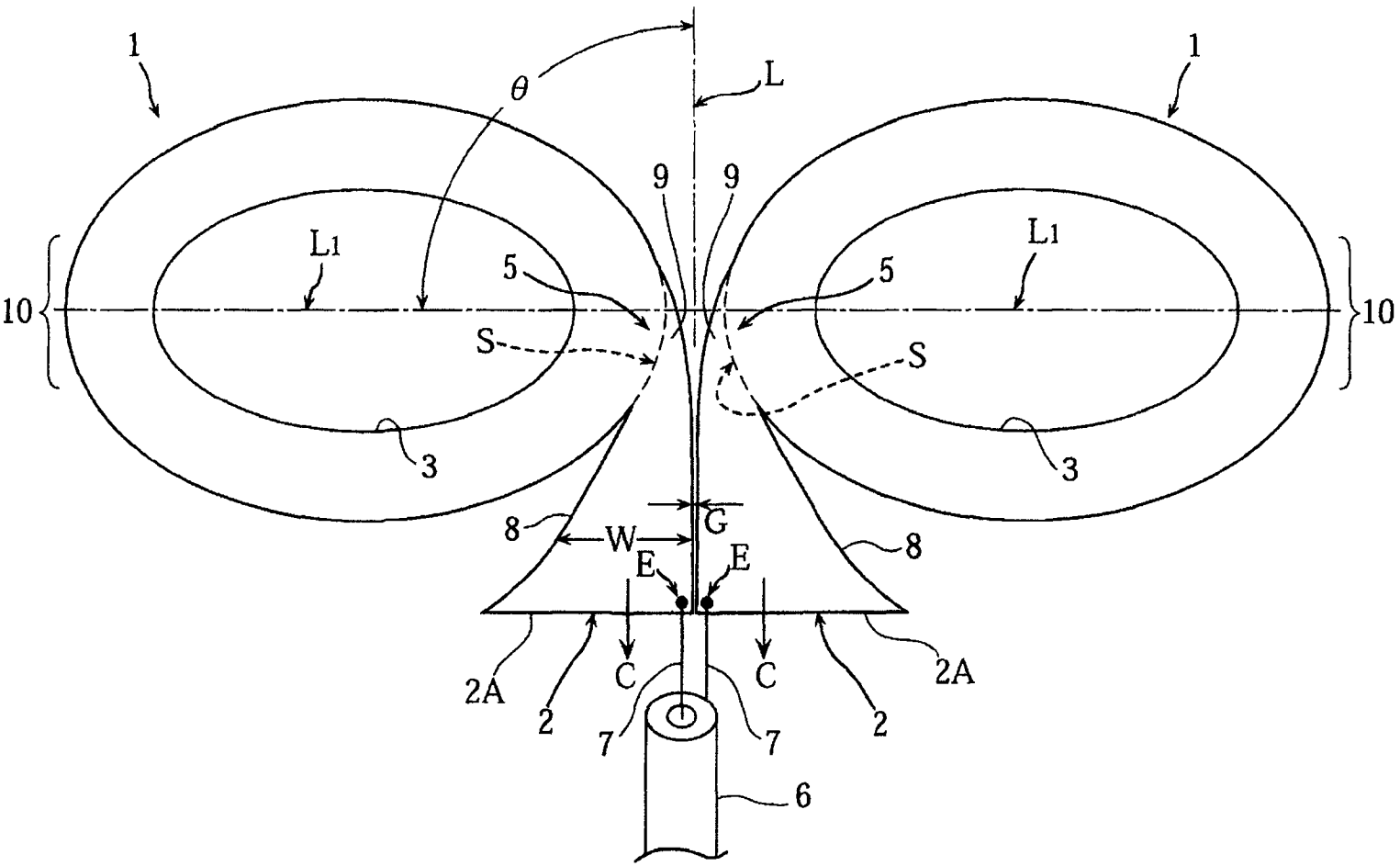
FIG. 1 is a front view for illustrating the first embodiment of the present invention.
Figure 2:
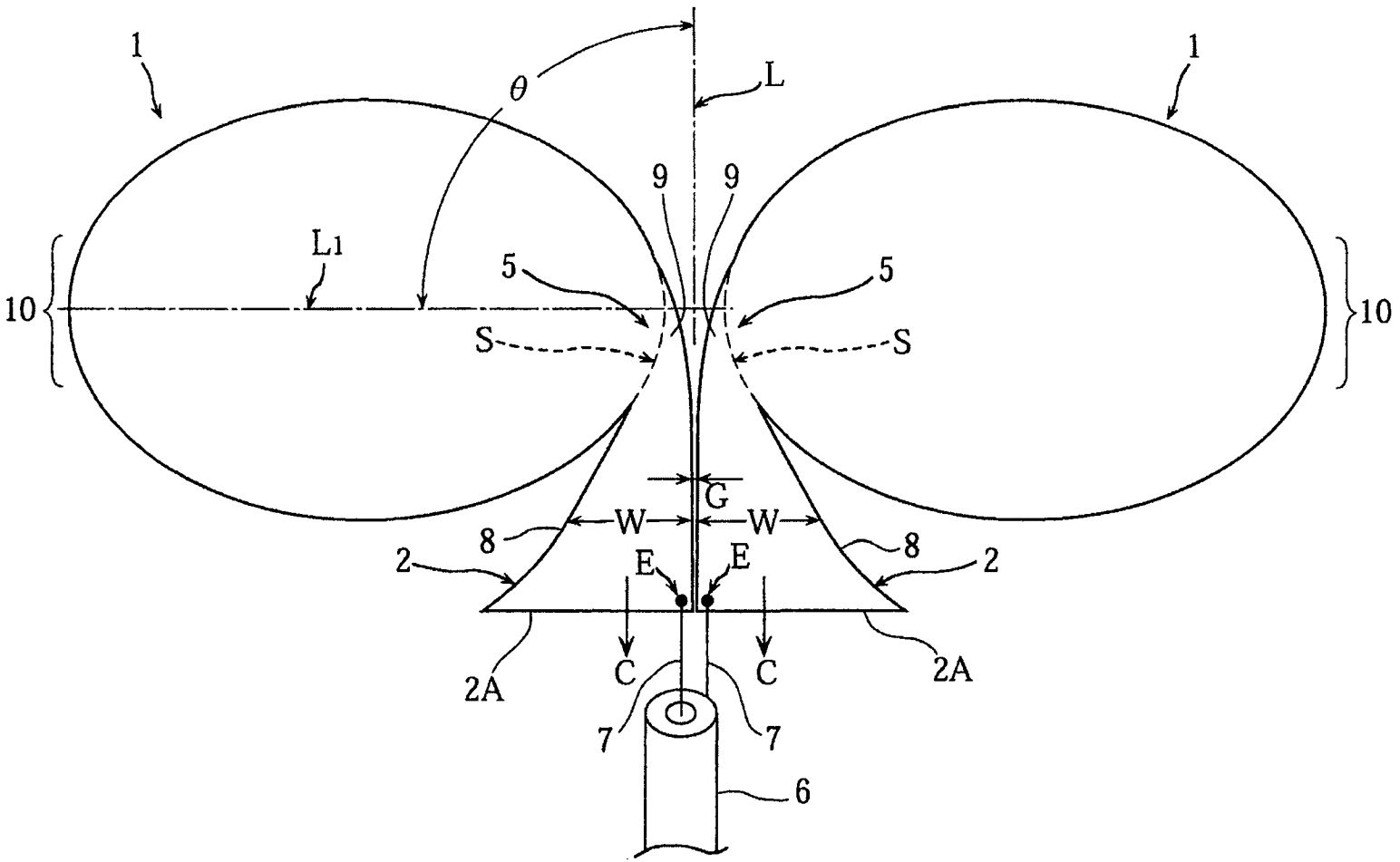
FIG. 2 is a front view for illustrating the second embodiment of the present invention.

FIG. 1 is a front view according to the first embodiment of the present invention. FIG. 2 is a front view according to the second embodiment of the present invention.

A pair of planar, conductive antenna elements 1, 1 are arranged symmetrically with respect to line L, i.e., an axis of symmetry. A pair of planar, conductive band-like feeding legs 2, 2 protrude from adjacent portions 5, 5 of the antenna elements 1, 1. The antenna elements 1, 1 and the legs 2, 2 are integrally formed.

The pair of legs 2, 2 are arranged symmetrically with respect to the line L so as to be adjacent to each other, with a narrow space G interposed between the pair of legs 2, 2.

The feeding legs 2, 2 are connected to the adjacent portions of the antenna elements 1, 1 at which the antenna elements 1, 1 are closest to each other.

The width W of each of the legs 2, 2 is gradually increased in the outer end direction C, i.e., in a direction away from a connecting portion S. The leg 2 having an outwardly increasing width and the antenna element 1 are preferably formed of one thin metal plate. Specifically, the antenna element 1 and the leg 2 are made of a thin metal plate (a metal foil) of such as Cu, Al, Ag, and Au, or a metal oxide film (e.g., ITO-, or SnO-based film), which has a thickness dimension T (not shown) of 100 μm or less, and can be implemented by being attached to glass or an electronic substrate, etc.

For example, the antenna element 1 and the leg 2 can be attached to a glass surface, such as front glass, rear glass, and window glass of a vehicle. If the transmittances of visible light of the antenna elements 1, 1 and the legs 2, 2 are set in particular to 70% to 95%, the antenna elements 1, 1 and the legs 2, 2 are transparent to human eyes. Thus, the antenna elements 1, 1 and the legs 2, 2 may be made of a meshed, or very thin (e.g., 0.05 μm) metal film or metal oxide film.

To attach the antenna elements 1, 1 and the legs 2, 2 to glass, an adhesive material, a sticky material, etc. may be applied to the glass. Alternatively, the antenna elements 1, 1 and the legs 2, 2 may be layered on the glass by deposition. In another embodiment, the antenna elements 1, 1 and the legs 2, 2 are sandwiched and fixed between glass layers. All of these techniques are in the scope of the present invention.

The narrow space G between the pair of legs 2, 2 is tapered, that is, gradually increased from the outer end 2A toward the adjacent portion 5 of the antenna element 1. In other words, the narrow space G is gradually decreased from the adjacent area 5 in the outer end direction C.

The antenna element 1 has a substantially oval shape. In FIG. 1, a window 3 having a similar substantially oval shape is formed in a central region. Thus, the antenna element 1 forms a closed annular ring. In FIG. 2, no window 3 is formed.

A cable 6 is for connecting the antenna to an electronic circuit (e.g., an amplifier or a filter). The cable 6 is connected to feeding points E of the outer ends 2A of the legs 2 via wires (i.e., lead wires) 7. It is preferable that the feeding points E are provided at locations close to the narrow space G, i.e., at corners of the legs 2, 2.

The outer end portion 8 of the leg 2 has a recessed arc shape having a large radius of curvature.

As shown in FIG. 1 and FIG. 2, the outermost end 10 which is farthest from the adjacent portion 5 of the antenna element 1 forms a smooth arc. The adjacent portion 5, too, forms a smooth arc. In FIG. 1 and FIG. 2, the outer shape of the antenna element 1 is substantially oval, and therefore, the outermost end 10 and the adjacent portion 5 can be considered as forming an arc.

An inner edge 9 of the leg 2 is joined to the adjacent portion 5 of the antenna element 1 from a direction of a tangent line coming into contact with an arc-shaped phantom arc (a phantom curve) of the adjacent portion 5, that is, an approximately oval-shaped portion having a small radius of curvature (i.e., the curved portion in the drawing), thereby forming a joint portion S (shown in dotted line).

In FIG. 1 and FIG. 2, the antenna element 1 has a substantially oval shape, and the longer axis L1 of the oval shape intersects with the symmetric axis L at an angle θ of 90°. This means that the leg 2 is joined to the adjacent portion 5 of the antenna element 1 from a direction orthogonal to the longer axis L1, thereby forming the smoothly curved joint portion S. The arc length of the joint portion S is sufficiently longer than a minimum value of the width W of the leg 2.

In FIG. 1, if the area of the entire oval shape of the antenna element 1 (i.e., the area of the antenna element 1 in FIG. 2) is S0, and the area of the window 3 is S3, the ratio of these areas (shown in percentages) is set to satisfy the following formula 1. That is, the lower limit includes the antenna element 1 in FIG. 2.

$$0\% \leq S3/S0 \leq 35\% \quad (1)$$

Figure 4:
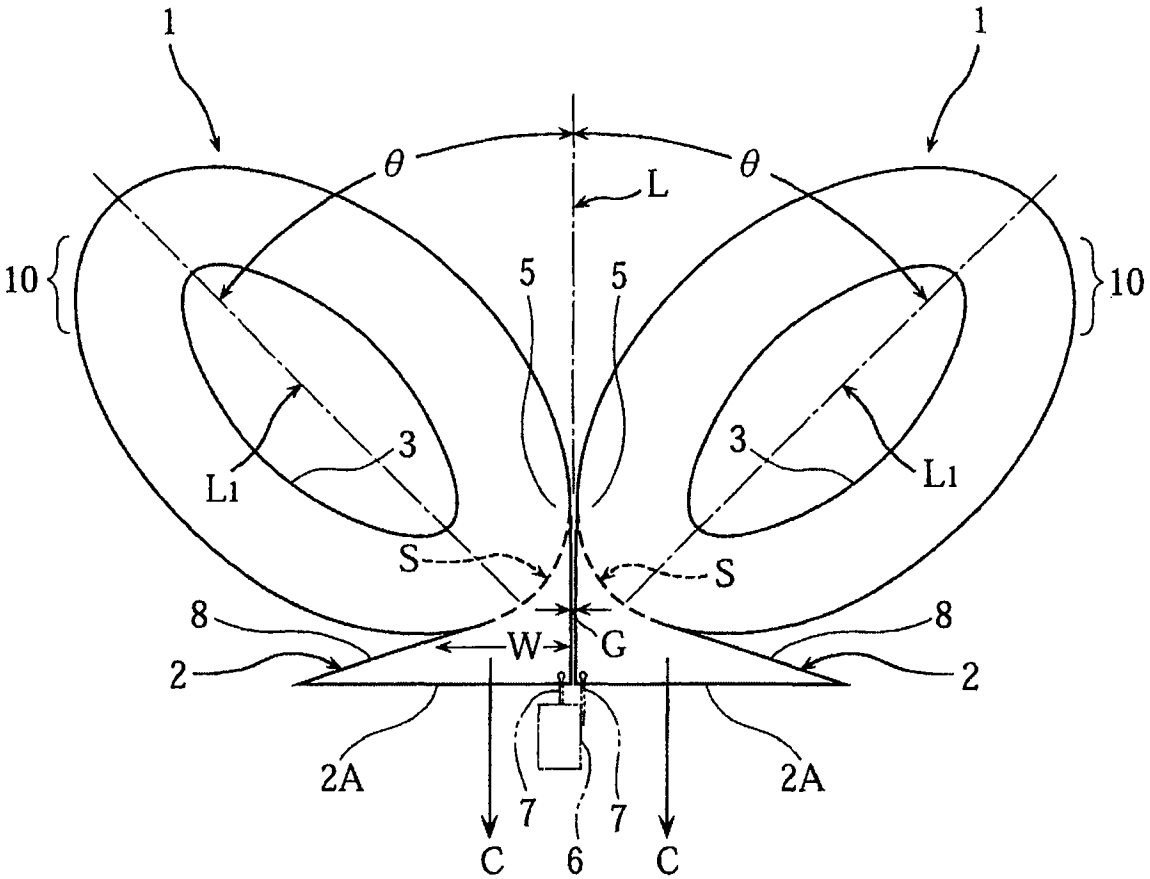
FIG. 4 is a front view for illustrating the third embodiment of the present invention.
Figure 5:
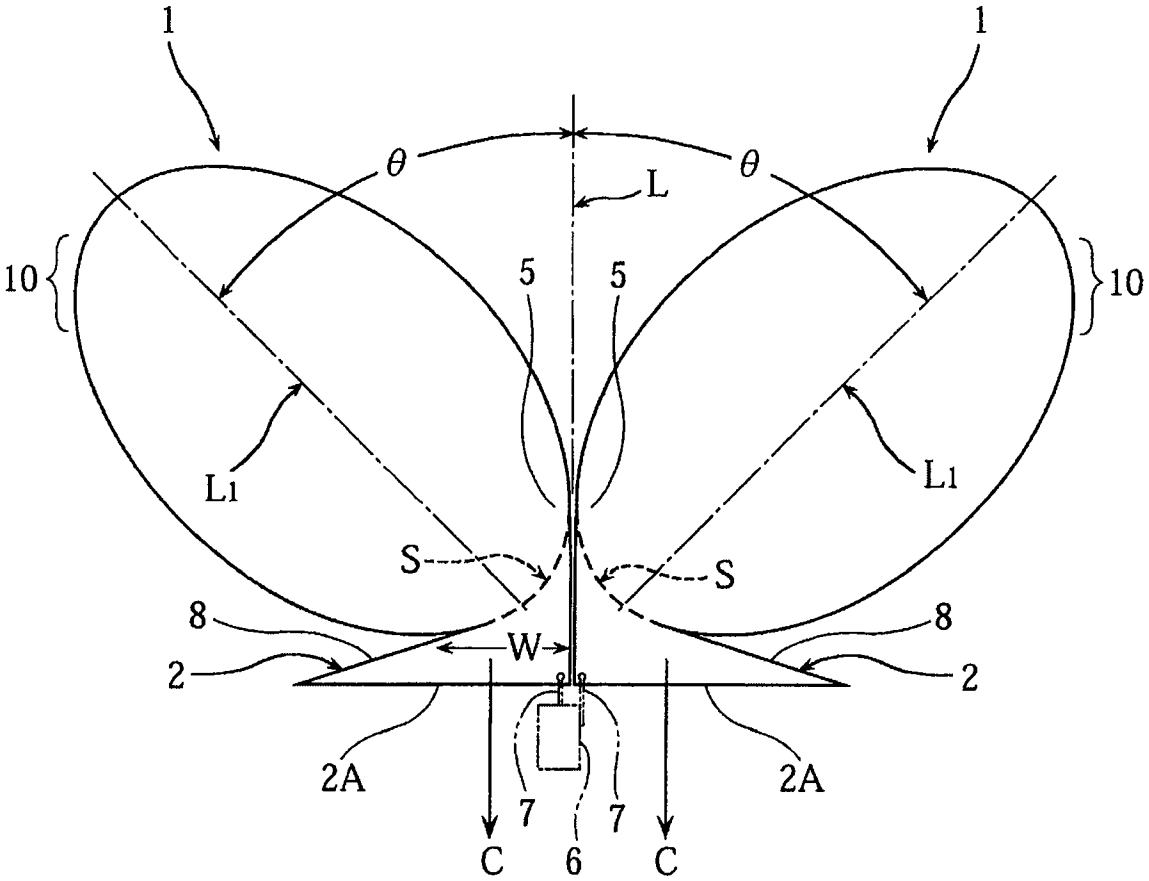
FIG. 5 is a front view for illustrating the fourth embodiment of the present invention.
Figure 6:
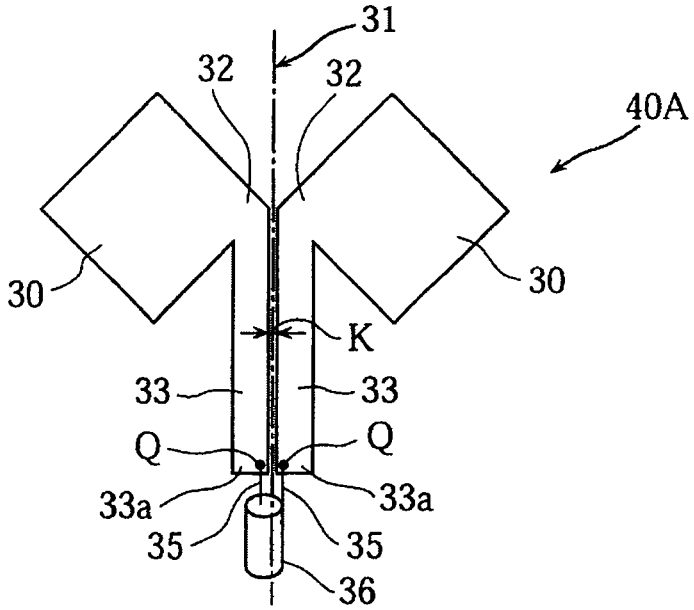
In FIG. 6, (A) is a front view of a conventional antenna having 25 mm squared elements, and (B) is a front view of a conventional antenna having 50 mm squared elements.
Figure 6:
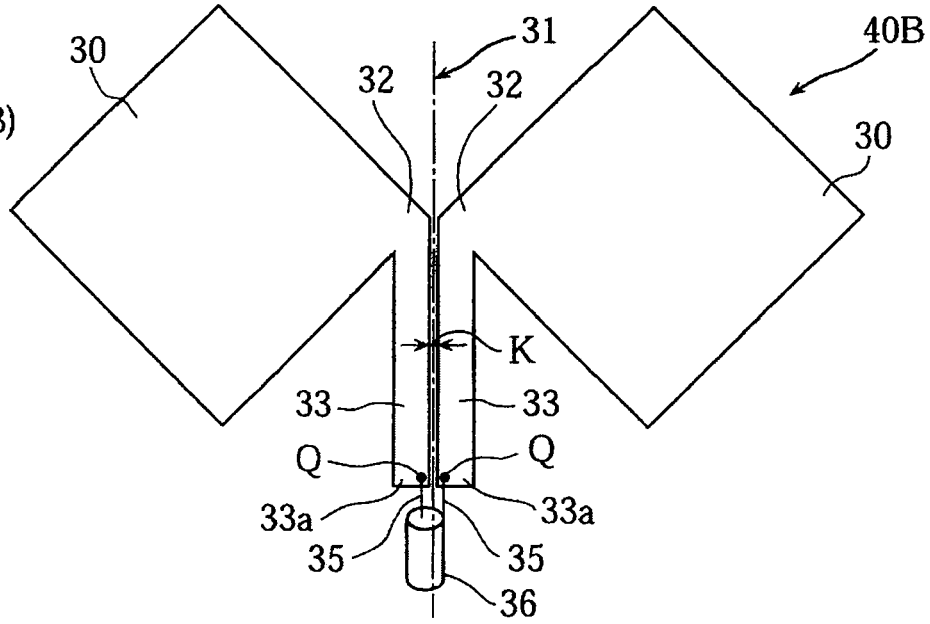

FIG. 4 and FIG. 5 show the third and fourth embodiments, respectively. The outer shape of the antenna element 1 is substantially oval, as in the above embodiments. The embodiments illustrated in FIG. 4 and FIG. 5 are different from the first and second embodiments shown in FIG. 1 and FIG. 2 in that the longer axis L1 intersects with the line L at an angle θ of 45°. According to the present invention, the angel formed by the line L, which extends from the outer end 2A side of the leg 2 toward the antenna element 1, and the longer axis L1, is represented as the angle θ, and it is preferable that the angle θ is set to a range of $40° \leq \theta \leq 100°$. In both of the cases where the angle θ is smaller than the lower limit, and the angle θ is larger than the upper limit, characteristics of a lower frequency region are abruptly degraded.

The lengths of the legs 2 shown in FIG. 4 and FIG. 5 along the line L are shorter than the lengths of the legs 2 shown in FIG. 1 and FIG. 2. Given that the length from the barycenter (i.e., the center) of the antenna element 1 to the outer end 2A of the leg 2 is the same as that in FIG. 1 and FIG. 2, the angle θ of the antenna element 1 is 45° as shown, for example, in FIG. 4 and FIG. 5. That is, if the longer axis L1 intersects with the symmetric axis L from an oblique direction, the joint portion S is located at a lower portion of the leg 2. Therefore, the length of the leg 2 becomes shorter. The outer end portion 8 forms a straight line. Thus, each of the legs 2 is in the shape of a substantially flattened triangle of which the width W is abruptly increased in the outer end direction C.

The structures in FIG. 4 and FIG. 5 other than those described above are similar to the structures in FIG. 1 and FIG. 2 labeled with the same reference characters. Although FIG. 4 and FIG. 5 show that the adjacent portion 5 and the outermost end 10 are located away from the longer axis L1, the adjacent portion 5 and the outermost end 10 are in the form of an arc, that is, having no corner, which is similar to those shown in FIG. 1 and FIG. 2.

Figure 3:
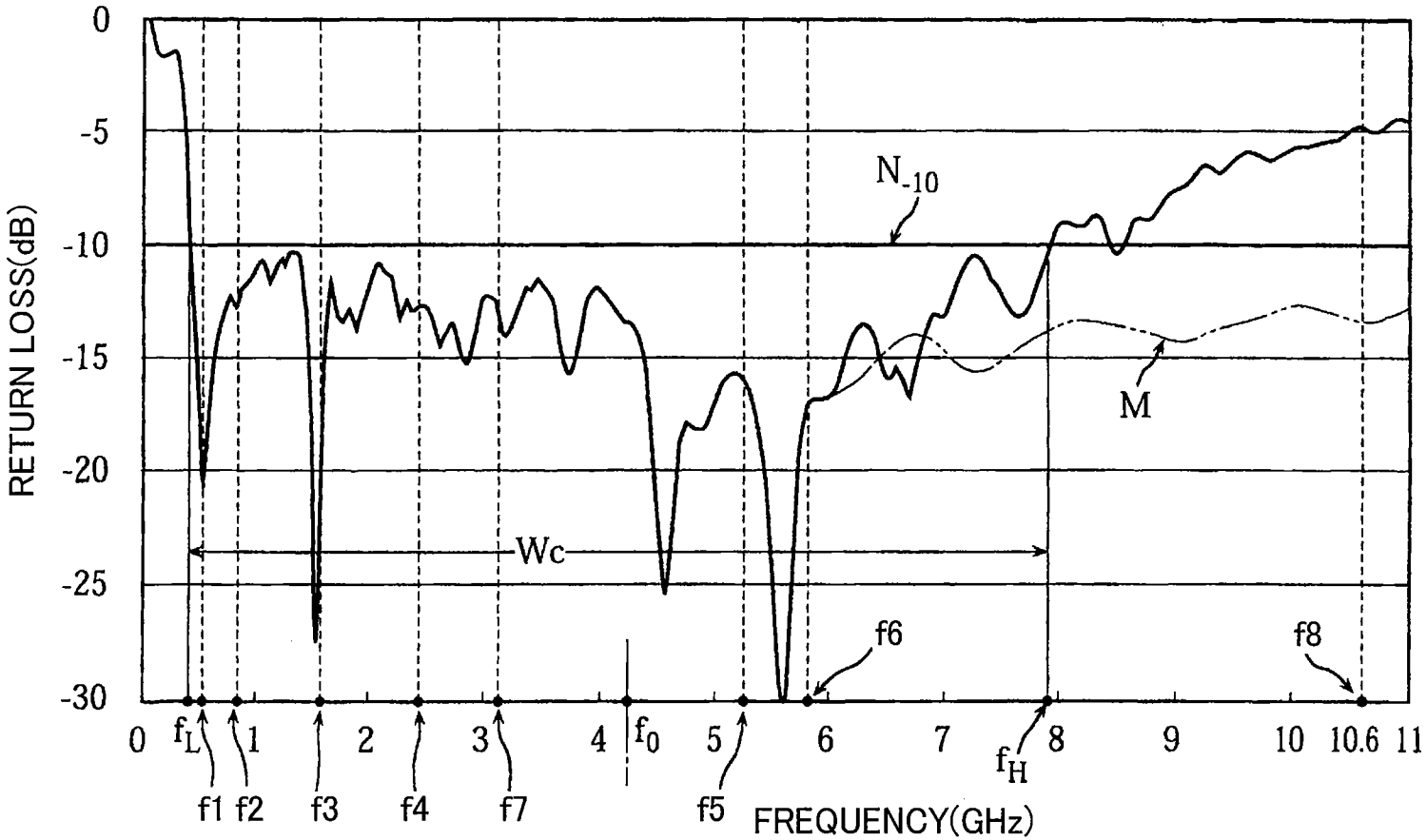
FIG. 3 is a graph for showing a result of actual measurement of an example which corresponds to FIG. 1 of the present invention.

The graph in FIG. 3 shows characteristics of a frequency measured in the embodiment shown in FIG. 1. The horizontal axis represents a frequency (GHz). The vertical axis represents a return loss (dB). Specifically, according to this embodiment, Cu is used as a material; the thickness dimension is 35 μm; the length dimension of the antenna element 1 along the longer axis L1 is 100 mm; the dimension of the shorter axis is 70 mm; the dimension of the longer axis of the oval shape of the window 3 is 70 mm; the dimension of the shorter axis is 40 mm; S3/S0=33%; the distance from the longer axis L1 to the outer end 2A of the leg 2 is 50 mm; the length of the side of the outer end 2A is 35 mm; the radius of curvature of the outer end portion 8 is 50 mm; and a value of the narrow space G adjacent to the outer end 2A is 0.5 mm.

As shown in FIG. 3, the frequency band We in which a loss (dB) is equal to or less than the line $N_{-10}$ of −10 dB, which was mentioned earlier, is sufficiently wide. In other words, a return loss of equal to or less than the line $N_{-10}$ of −10 dB was obtained in a wide band ranging from a frequency $f_L$ to a higher frequency $f_H$. Specifically, the $f_L$ is 0.4 GHz, and the $f_H$ is 7.9 GHz. The middle of these frequencies (i.e., an average frequency) is represented as $f_0$. According to the present invention, the antenna satisfying the following formula 2 is defined as a "wideband antenna"

$$(f_H-f_L)/f_0 \geq 1.0 \quad (2)$$

According to the embodiment shown in FIG. 3, $(f_H-f_L)=7.9-0.4=7.5$, and $f_0=(7.9+0.4)\div 2=4.15$ Therefore, $(f_H-f_L)/f_0=7.5\div 4.15=1.81$ Consequently, suitable return loss characteristics which are equal to or less than −10 dB are obtained in a sufficiently wide frequency band.

It is possible to also cover 10.6 GHz for UWB communications, as shown in dot-dot-dash line in FIG. 3, by optimizing the shape and dimensions of the leg 2, and the narrow space G of the structure shown in FIG. 1 or FIG. 2. This has already been found by the inventors of the present application.

In FIG. 3, each of the reference characteristics of f1-f2, f3, f4, f5, f6, f7-f8 on the horizontal axis indicates a major frequency presently used in Japan, as shown in Table 1 below.

TABLE 1

| REFERENCE CHARACTERISTICS | FREQUENCY USED | PURPOSE |
|---|---|---|
| f1-f2 | 470 MHz-770 MHz | digital terrestrial television broadcasting |
| f3 | 1575 MHz | GPS |
| f4 | 2.45 GHz | Wireless LAN (IEEE802.11b/g) |
| f5 | 5.25 GHz | Wireless LAN (IEEE802.11a) |
| f6 | 5.8 GHz | ETC |
| f7-f8 | 3.1 GHz-10.6 GHz | UWB |

Figure 7:
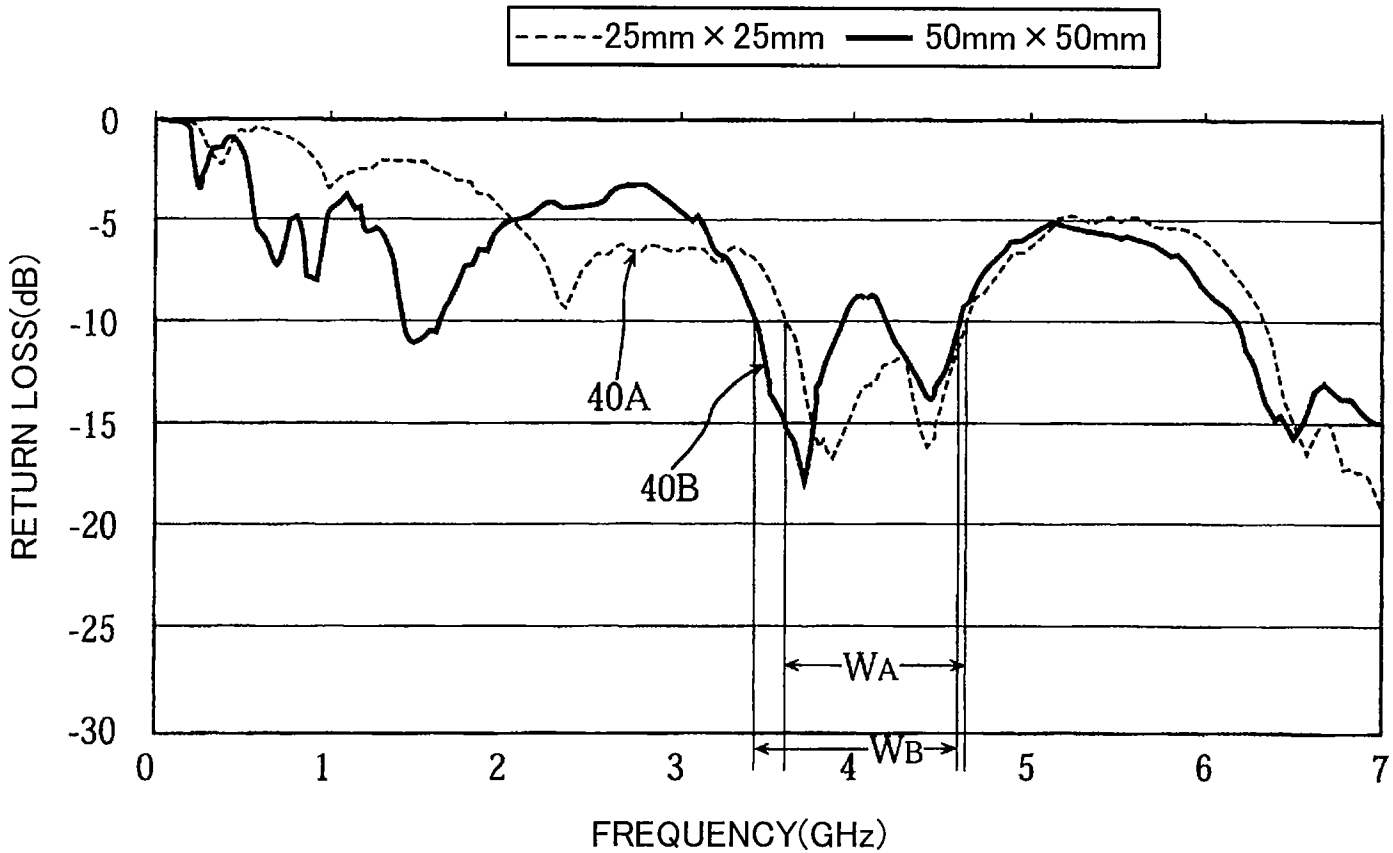
FIG. 7 is a graph for showing results of actual measurements of the conventional antennas.

As shown in Table 1 and FIG. 3, the present invention can provide a single-body, integrated wideband antenna capable of covering digital terrestrial television broadcasting, GPS, wireless LAN, ETC, etc. For example, the wideband antenna of the present invention is very useful as an antenna attached, for example, to the front glass of a vehicle. Comparison between the graph in FIG. 3 showing an embodiment of the present invention and the graph in FIG. 7 showing the conventional antennas shows how widely the antenna of the present invention can cover a frequency band. The present invention can provide an antenna having wideband characteristics which is capable of being used for UWB communications, as well, as indicated in dot-dot-dash line M in FIG. 3.

As described above, in the present invention, a pair of thin, planar antenna elements 1, 1 are arranged symmetrically with respect to the line L. A pair of planar feeding legs 2, 2 are formed so as to protrude from the adjacent portions 5, 5 of the antenna elements 1, 1, and are arranged symmetrically with respect to the line L and close to each other, with a narrow space G interposed between the pair of feeding legs 2, 2. Each of the legs 2, 2 has a shape whose width W is gradually increased in the outer end direction C. Thus, the legs 2, 2 form a wideband impedance matching circuit where the characteristic impedance gradually varies. Accordingly, the antenna is capable of receiving a sufficiently wide band of frequencies, and therefore, antennas of a plurality of wireless communication systems can be integrated. This structure has an advantage over a plurality of antennas which were required in conventional antennas. As a result, it is possible to simplify complicated wiring. This greatly contributes to the communications requiring a very wide band of frequencies, such as UWB communications. Further, since the antenna of the present invention has a thin, planar shape, the antenna of the present invention can easily adhere, for example, to the front glass of a vehicle, and is highly practical.

The outermost end 10 which is farthest from the adjacent portion 5 of the antenna element 1 forms a smooth arc. In addition, the adjacent portion 5 of the antenna element 1 has a smooth arc shape, and the leg 2 is joined to the adjacent portion 5 of the antenna element 1 from a direction of a tangent line coming into contact with the phantom arc of the arc shape, thereby forming the joint portion S. Accordingly, as shown in FIG. 3, such a characteristic in which only part of the curve of the return loss below the line of −10 dB protrudes above the line of −10 dB with a sharp peak, is not exhibited. Thus, stable return loss characteristics are obtained in a wide frequency band.

According to an embodiment, the antenna element 1 is in the form of a closed annular ring, with the window 3 formed in a central region. Thus, superior return loss characteristics can be obtained in a wide frequency band.

According to an embodiment, the antenna element 1 has an approximately oval shape, and the angle of θ at which the longer axis L1 of the oval shape intersects with the line L is set to 40° to 100°. Thus, the antenna element 1 has a simple shape, and superior return loss characteristics can be obtained in a stable manner in a wide frequency band.

According to an embodiment, the antenna element 1 has an approximately oval shape, and the angle θ at which the longer axis L1 of the oval shape intersects with the line L is set to about 90°. Thus, the antenna element 1 has a simple shape, and superior return loss characteristics can be obtained in a very wide frequency band. As a result, the antenna can be applied to communications, such as UWB communications, which require a wide band of frequencies.

According to an embodiment, the antenna elements 1, 1 and the legs 2, 2 are transparent to human eyes because the transmittances of visible light of the antenna elements 1, 1 and the legs 2, 2 are set to 70% to 95%. Thus, the antenna can be attached to a transparent glass surface of a vehicle, a window, etc.

According to an embodiment, the antenna is attached to a glass surface of a vehicle. Thus, even if the antenna is made of a thin metal flake (foil), the antenna is sufficiently reinforced and has durability. Further, various communications, such as ETC, GPS, wireless LAN, which are needed for a vehicle can be accomplished by an antenna which can be unobtrusively located.

INDUSTRIAL APPLICABILITY

The present invention is useful as an antenna capable of receiving a wide band of frequencies.

DESCRIPTION OF REFERENCE CHARACTERS

1 antenna element
2 leg
2A outer end
5 adjacent portion
10 outermost end
C outer end direction
G narrow space
L symmetric axis
L1 longer axis
S joint portion
θ angle

The invention claimed is:

1. A wideband antenna, comprising:

a pair of planar, conductive antenna elements; and a pair of planar, conductive band-like feeding legs, wherein the antenna elements are arranged symmetrically with respect to a symmetric axis, the band-like feeding legs are arranged symmetrically with respect to the symmetric axis, with a narrow space interposed between the band-like feeding legs, the band-like feeding legs are connected to adjacent portions of the antenna elements at which the antenna elements are closest to each other, and a width of each of the band-like feeding legs is increased in a direction away from the connecting portion, and wherein an outer edge portion of each of the antenna elements that is farthest from the connecting part forms part of an arc, each of the adjacent portions includes part of a phantom arc, and each of the legs is joined to the corresponding antenna element along a direction of a tangent line coming into contact with the phantom arc of the adjacent portion, thereby forming a joint portion.

2. The wideband antenna of claim 1, wherein each of the antenna elements forms a closed annular ring having a window in a central region.

3. The wideband antenna of claim 1, wherein each of the antenna elements has a substantially oval shape, and an angle at which a longer axis of the oval shape intersects with the symmetric axis is 40° to 100°.

4. The wideband antenna of claim 3, wherein the angle at which the longer axis of the oval shape intersects with the symmetric axis is about 90°.

5. The wideband antenna of claim 1, wherein transmittances of visible light of the antenna elements and the legs are 70% to 95% so that the antenna elements and the legs are transparent to human eyes.

6. The wideband antenna of claim 1, wherein the antenna elements and the legs are provided on a glass surface of a vehicle.

7. A wideband antenna, comprising:

a pair of planar, conductive antenna elements; and a pair of planar, conductive band-like feeding legs, wherein the antenna elements are arranged symmetrically with respect to a symmetric axis, the band-like feeding legs are arranged symmetrically with respect to the symmetric axis, with a narrow space interposed between the band-like feeding legs, the band-like feeding legs are connected to adjacent portions of the antenna elements at which the antenna elements are closest to each other, an outer edge portion of each of the antenna elements that is farthest from the connecting part forms part of an arc, each of the adjacent portions includes part of a phantom arc, each of the band-like feeding legs is joined to the corresponding antenna element along a direction of a tangent line coming into contact with the phantom arc of the adjacent portion, thereby forming a joint portion, each of the band-like feeding legs includes an outer periphery which is a concave arc, and a width of each of the band-like feeding legs is increased in a direction away from the connecting part.

8. The wideband antenna of claim 1, wherein a width of the narrow space is increased in a direction away from outer ends of the band-like feeding legs.

9. The wideband antenna of claim 7, wherein a width of the narrow space is increased in a direction away from outer ends of the band-like feeding legs.

* * * * *